US009429098B2

(12) United States Patent
Yamada

(10) Patent No.: US 9,429,098 B2
(45) Date of Patent: Aug. 30, 2016

(54) FUEL INJECTION CONTROLLER

(75) Inventor: Naoyuki Yamada, Kariya (JP)

(73) Assignee: DENSO CORPORATION, Kariya (JP)

( * ) Notice: Subject to any disclaimer, the term of this patent is extended or adjusted under 35 U.S.C. 154(b) by 844 days.

(21) Appl. No.: 13/586,029

(22) Filed: Aug. 15, 2012

(65) Prior Publication Data

US 2013/0054120 A1 Feb. 28, 2013

(30) Foreign Application Priority Data

Aug. 22, 2011 (JP) ..... 2011-180319

(51) Int. Cl.

| | |
|---|---|
| ***F02D 41/38*** | (2006.01) |
| ***F02M 65/00*** | (2006.01) |
| ***F02D 41/24*** | (2006.01) |
| *F02D 41/40* | (2006.01) |
| *F02D 41/14* | (2006.01) |
| *F02D 41/00* | (2006.01) |
| *F02D 41/30* | (2006.01) |

(52) U.S. Cl.

CPC ..... *F02D 41/3836* (2013.01); *F02D 41/247* (2013.01); *F02M 65/001* (2013.01); *F02D 41/0085* (2013.01); *F02D 41/1497* (2013.01); *F02D 41/3005* (2013.01); *F02D 41/40* (2013.01); *F02D 2200/0602* (2013.01); *F02D 2250/04* (2013.01)

(58) Field of Classification Search

CPC ..... F02D 2041/2055; F02D 2041/224; F02D 41/247; F02D 41/2464; F02D 41/2467; F02D 41/008; F02D 41/0085; F02D 41/1497; F02D 41/3005; F02D 41/3094; F02D 41/40; F02D 2200/0602; F02D 2200/06; F02D 2200/0618; F02D 2200/0616; F02D 2200/0614; F02M 65/001; F02M 65/005

See application file for complete search history.

(56) References Cited

U.S. PATENT DOCUMENTS

| | | | | |
|---|---|---|---|---|
| 7,845,343 | B2 * | 12/2010 | Imai | F02D 41/1497 123/198 F |
| 8,851,052 | B2 * | 10/2014 | Brox | F02D 35/023 123/299 |
| 2004/0267433 | A1 | 12/2004 | Asano et al. | |
| 2008/0228374 | A1 | 9/2008 | Ishizuka et al. | |
| 2008/0236547 | A1 * | 10/2008 | Takahashi et al. | 123/447 |
| 2008/0281500 | A1 | 11/2008 | Nakata et al. | |
| 2009/0063010 | A1 * | 3/2009 | Nakata et al. | 701/103 |

(Continued)

OTHER PUBLICATIONS

Office Action (7 pages) dated Dec. 22, 2014, issued in corresponding Chinese Application No. 201210297592.9 and English translation (8 pages).

(Continued)

*Primary Examiner* — Erick Solis
*Assistant Examiner* — Anthony L Bacon
(74) *Attorney, Agent, or Firm* — Nixon & Vanderhye PC

(57) ABSTRACT

A fuel injection controller includes an output detecting portion detecting a first output generated by a combustion of a fuel which a sensor-injector injects and a second output generated by a combustion of a fuel which the second fuel injector injects, a first injection quantity computing portion computing, based on a detection value of the fuel pressure sensor, a first injection quantity injected by the sensor-injector injector to generate the first output, and a second injection quantity estimating portion estimating a second injection quantity injected by the second fuel injector to generate the second output, based on the first output, the second output and the first injection quantity.

4 Claims, 8 Drawing Sheets

(56) References Cited

U.S. PATENT DOCUMENTS

| | | | | |
|---|---|---|---|---|
| 2009/0326788 | A1 | 12/2009 | Yuasa et al. | |
| 2010/0250095 | A1* | 9/2010 | Yamada et al. | 701/103 |
| 2010/0250096 | A1* | 9/2010 | Yamada et al. | 701/103 |
| 2010/0250097 | A1 | 9/2010 | Yamada et al. | |
| 2010/0250102 | A1 | 9/2010 | Imai et al. | |
| 2012/0041666 | A1* | 2/2012 | Kemmer et al. | 701/104 |
| 2012/0240670 | A1* | 9/2012 | Takashima | 73/114.49 |

OTHER PUBLICATIONS

Office Action (1 page) dated Apr. 22, 2014, issued in corresponding Japanese Application No. 2011-180319 and English translation (1 page).

Office Action (2 pages) dated Aug. 20, 2013, issued in corresponding Japanese Application No. 2011-180319 and English translation (2 pages).

* cited by examiner

FUEL INJECTION CONTROLLER

CROSS-REFERENCE TO RELATED APPLICATION

This application is based on Japanese Patent Application No. 2011-180319 filed on Aug. 22, 2011, the disclosure of which is incorporated herein by reference.

TECHNICAL FIELD

The present disclosure relates to a fuel injection controller which estimates a quantity of fuel injected by a fuel injector and controls an operation of the fuel injector based on the estimated fuel quantity.

BACKGROUND

In a conventional engine control system, an injection-quantity command value (injector-opening-period command value), which indicates a fuel quantity injected by a fuel injector, is corrected by executing a small-injection-quantity learning which will be described below. That is, when the vehicle is decelerated without injecting fuel, a small quantity of fuel is compulsorily injected, whereby an engine speed NE is slightly increased. Based on an increase ΔNE in engine speed, an increase ΔTrq in engine output torque is computed. Further, based on the increase ΔTrq, an actual fuel injection quantity Qact can be computed. A deviation between the actual quantity Qact and the injector-opening-period command value is learned as an injection quantity correction value so that the injector-opening-period command value is corrected. This learning is referred to as a small-injection-quantity learning.

In order to execute the small-injection quantity learning, it is necessary to previously obtain a conversion factor for converting the increase ΔTrq into the injection quantity Qact by experiments. Further, since the conversion factor depends on an injection condition, such as a fuel supply pressure (pressure in a common-rail), an engine speed NE, a fuel temperature and the like, it is necessary to form a map of conversion factor with respect to every injection condition, which increases work load to form the map.

JP-2010-223182A, JP-2010-223183A, JP-2010-223184A and JP-2010-223185A respectively show a fuel injection system which is provided with a fuel pressure sensor detecting a fuel pressure in a fuel passage between a common-rail and an injection port of a fuel injector. Based on a detection value of the fuel pressure sensor, a fuel pressure waveform indicative of a variation in fuel pressure due to a fuel injection is detected. According to this system, since the injection-rate waveform indicative of the injection-rate can be computed based on the detected fuel pressure waveform, the injection quantity can be computed based on an area of the injection-rate waveform. That is, since the actual injection quantity is directly detected by a fuel pressure sensor, it is unnecessary to execute the correction based on the small-injection quantity learning, whereby it is unnecessary to form the map of conversion factor.

However, in a case that the above system is applied to a multi-cylinder engine, it is necessary that the fuel pressure sensor is provided to each of fuel injectors, which may increase its costs.

If only specified fuel injectors have the fuel pressure sensor, the number of the fuel injectors can be reduced. However, it becomes necessary to execute the above small-injection quantity learning with respect to the fuel injectors having no fuel pressure sensor, which increase a work load for forming the conversion factor map.

SUMMARY

It is an object of the present disclosure to provide a fuel injection controller which is able to accurately control a fuel injection quantity in a fuel injection system in which a number of fuel injector is reduced while a work load for forming a map is decreased.

A fuel injection controller is applied to a fuel injection system which includes a first fuel injector provided in a first cylinder of an engine; a second fuel injector provided in a second cylinder of the engine; and a fuel pressure sensor detecting a variation in fuel pressure in the first fuel injector when the first fuel injector injects a fuel.

The fuel injection controller includes: an output detecting portion detecting a first output generated by a combustion of a fuel which the first fuel injector injects and a second output generated by a combustion of a fuel which the second fuel injector injects; a first injection quantity computing portion computing a first injection quantity injected by the first fuel injector to generate the first output, based on a detection value of the fuel pressure sensor; and a second injection quantity estimating portion estimating a second injection quantity injected by the second fuel injector to generate the second output, based on the first output, the second output and the first injection quantity.

Even though the second fuel injector is provided with no fuel pressure sensor, the second injection quantity can be estimated based on the first output, the second output and the first injection quantity without using a map for converting the second output into the second injection quantity.

Thus, the second injection quantity which the second fuel injector injects can be controlled with high accuracy.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, embodiments of the present disclosure will be described. A fuel injection controller is applied to an internal combustion engine (diesel engine) having four cylinders #1-#4.

First Embodiment

Figure 1:
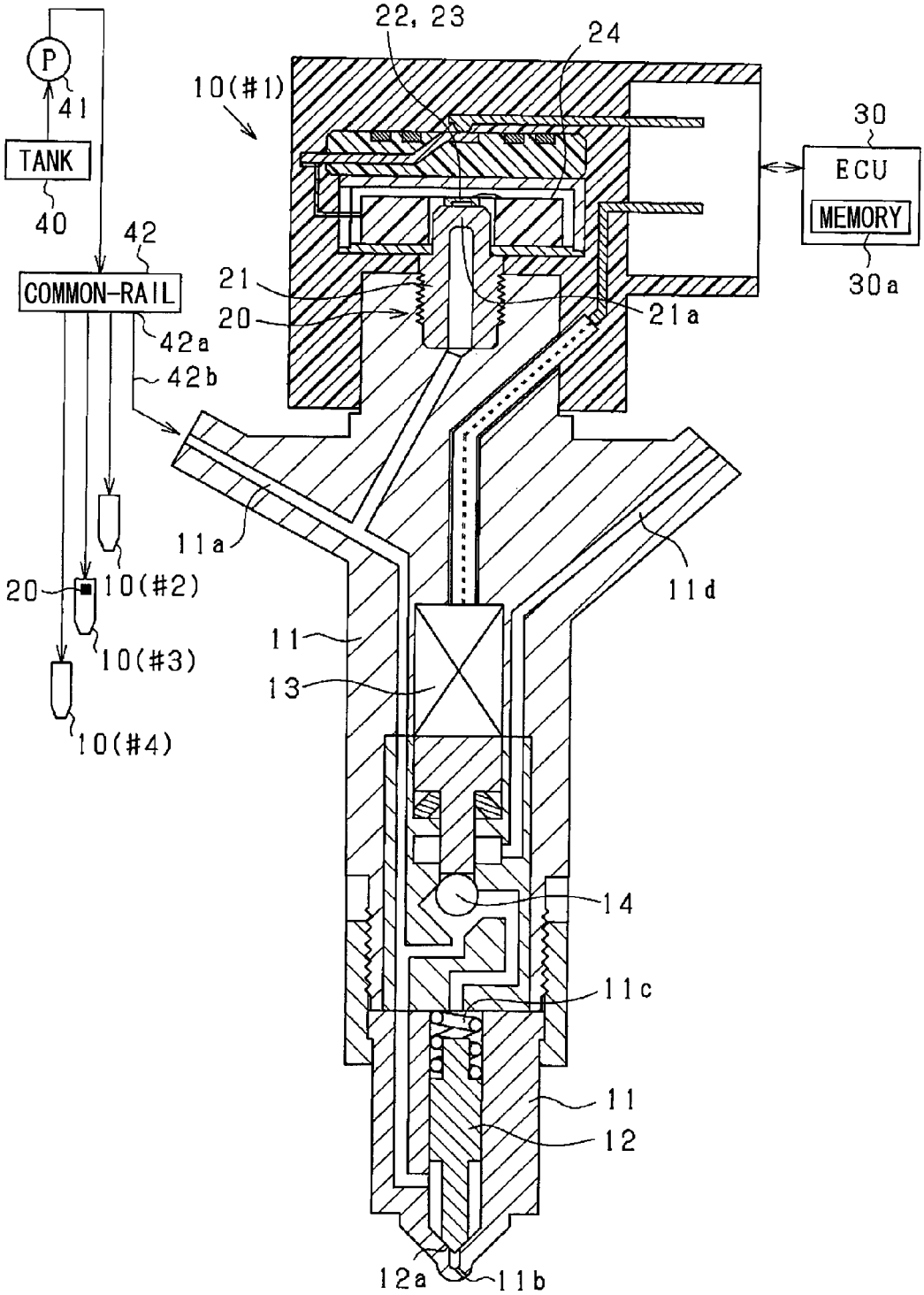
FIG. 1 is a construction diagram showing an outline of a fuel injection system on which a fuel injection controller is mounted, according to a first embodiment.

FIG. 1 is a schematic view showing fuel injectors 10 provided to each cylinder, a fuel pressure sensor 22 provided to each fuel injector 10, an electronic control unit (ECU) 30 and the like.

First, a fuel injection system of the engine including the fuel injector 10 will be explained. A fuel in a fuel tank 40 is pumped up by a high-pressure pump 41 and is accumulated in a common-rail (accumulator) 42 to be supplied to each fuel injector 10(#1-#4). Each of the fuel injectors 10(#1-#4) performs a fuel injection sequentially in a predetermined order. In the present embodiment, #1 fuel injector, #3 fuel injector, #4 fuel injector, and #2 fuel injector perform fuel injections in this order.

The high-pressure fuel pump 41 is a plunger pump which intermittently discharges high-pressure fuel. Since the fuel pump 41 is driven by the engine through the crankshaft, the fuel pump 41 discharges the fuel predetermined times during one combustion cycle.

The fuel injector 10 is comprised of a body 11, a needle valve body 12, an actuator 13 and the like. The body 11 defines a high-pressure passage 11*a* and an injection port 11*b*. The needle valve body 12 is accommodated in the body 11 to open/close the injection port 11*b*.

The body 11 defines a backpressure chamber 11*c* with which the high-pressure passage 11*a* and a low-pressure passage 11*d* communicate. A control valve 14 switches between the high-pressure passage 11*a* and the low-pressure passage 11*d*, so that the high-pressure passage 11*a* communicates with the backpressure chamber 11*c* or the low-pressure passage 11*d* communicates with the backpressure chamber 11*c*. When the actuator 13 is energized and the control valve 14 moves downward in FIG. 1, the backpressure chamber 11*c* communicates with the low-pressure passage 11*d*, so that the fuel pressure in the backpressure chamber 11*c* is decreased. Consequently, the back pressure applied to the valve body 12 is decreased so that the valve body 12 is lifted up (valve-open). A top surface 12*a* of the valve body 12 is unseated from a seat surface of the body 11, whereby the fuel is injected through the injection port 11*b*.

Meanwhile, when the actuator 13 is deenergized and the control valve 14 moves upward, the backpressure chamber 11*c* communicates with the high-pressure passage 11*a*, so that the fuel pressure in the backpressure chamber 11*c* is increased. Consequently, the back pressure applied to the valve body 12 is increased so that the valve body 12 is lifted down (valve-close). The top surface 12*a* of the valve body 12 is seated on the seat surface of the body 11, whereby the fuel injection is terminated.

The ECU 30 controls the actuator 13 to drive the valve body 12. When the needle valve body 12 opens the injection port 11*b*, high-pressure fuel in the high-pressure passage 11*a* is injected to a combustion chamber (not shown) of the engine through the injection port 11*b*.

Not all fuel injector 10 have the fuel pressure sensor 22 detecting a variation in fuel pressure in the fuel injector 10. In the present embodiment, #1 fuel injector 10 and #3 fuel injector 10, which are referred to as sensor-injectors, are provided with the fuel pressure sensor 22, and #2 fuel injector 10 and #4 fuel injector 10, which are referred to as no-sensor-injectors, are provided with no fuel pressure sensor 22. It should be noted that #1 sensor-injector 10 corresponds to a first fuel injector, and #2 no-sensor-injector 10 corresponds to a second fuel injector.

A sensor unit 20 having the fuel pressure sensor 22 is provided with a stem 21 (load cell), a fuel temperature sensor 23 and a molded IC 24. The stem 21 is provided to the body 11. The stem 21 has a diaphragm 21*a* which elastically deforms in response to high fuel pressure in the high-pressure passage 11*a*. The fuel pressure sensor 22 is disposed on a diaphragm 21*a* to transmit a pressure detection signal depending on an elastic deformation of the diaphragm 21*a* toward the ECU 30.

The fuel temperature sensor 23 is disposed on the diaphragm 21*a*. The fuel temperature detected by the temperature sensor 23 can be assumed as the temperature of the high pressure fuel. That is, the sensor unit 20 has functions of a fuel temperature sensor and a fuel pressure sensor. It should be noted that the fuel temperature sensor 23 is not always necessary in the present disclosure.

The molded IC 24 includes an amplifier circuit which amplifies a pressure detection signal transmitted from the sensors 22, 23 and includes a transmitting circuit which transmits the detection signal to the ECU 30. The molded IC 24 is electrically connected to the ECU 30 so that the amplified signals are transmitted to the ECU 30.

Figure 2A:
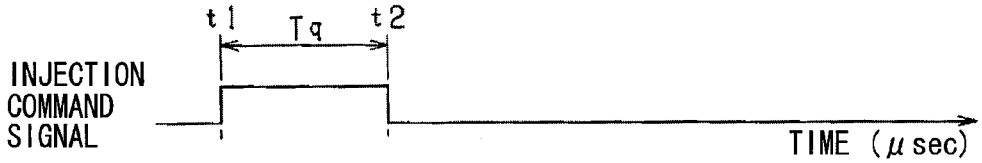
FIGS. 2A, 2B, and 2C are graphs showing variations in a fuel injection-rate and a fuel pressure relative to a fuel injection command signal.

The ECU 30 has a microcomputer which computes a target fuel injection condition, such as the number of fuel injections, a fuel-injection-start time, a fuel-injection-end time, and a fuel injection quantity. For example, the microcomputer stores an optimum fuel-injection condition with respect to the engine load and the engine speed in a fuel-injection condition map. Then, based on the current engine load and the engine speed, the target fuel-injection condition is computed in view of the fuel-injection condition map. The fuel-injection-command signals t1, t2, Tq (refer to FIG. 2A) corresponding to the computed target injection condition are established based on the injection-rate parameters td, te, Rα, Rβ, Rmax, which will be described later in detail. These fuel-injection-command signals are transmitted to the fuel injector 10.

Figure 2B:
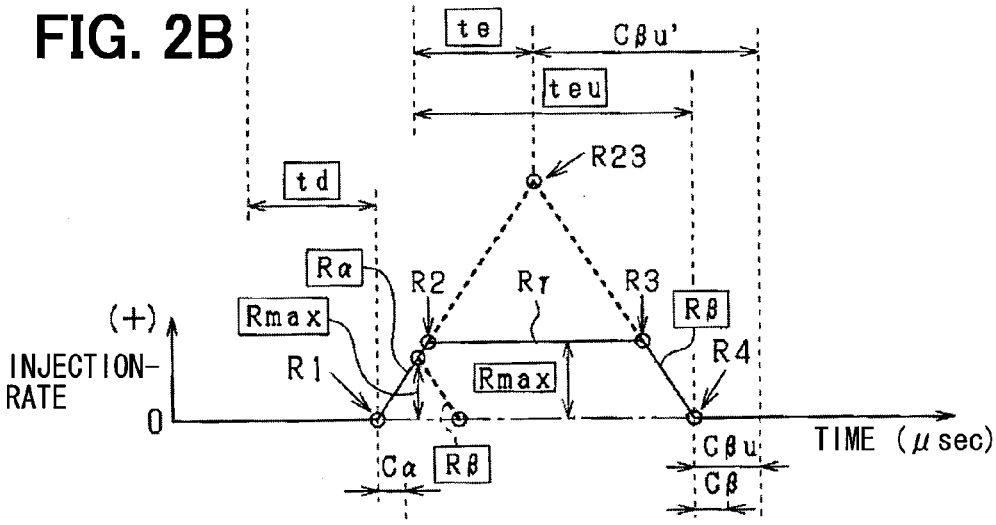
Figure 2C:
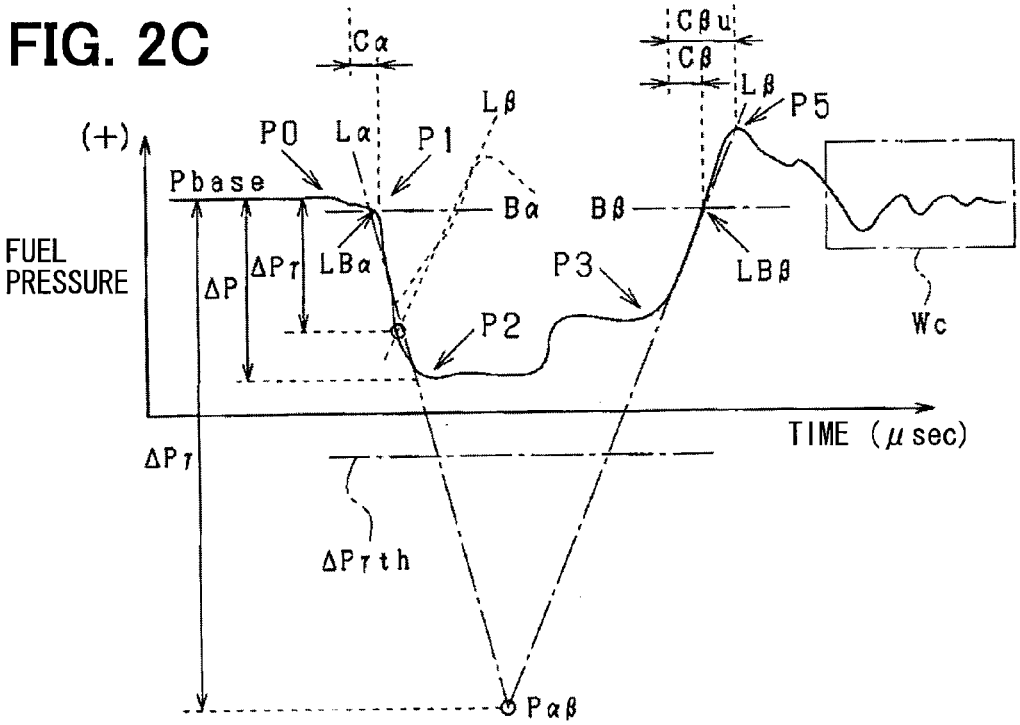
Figure 3:
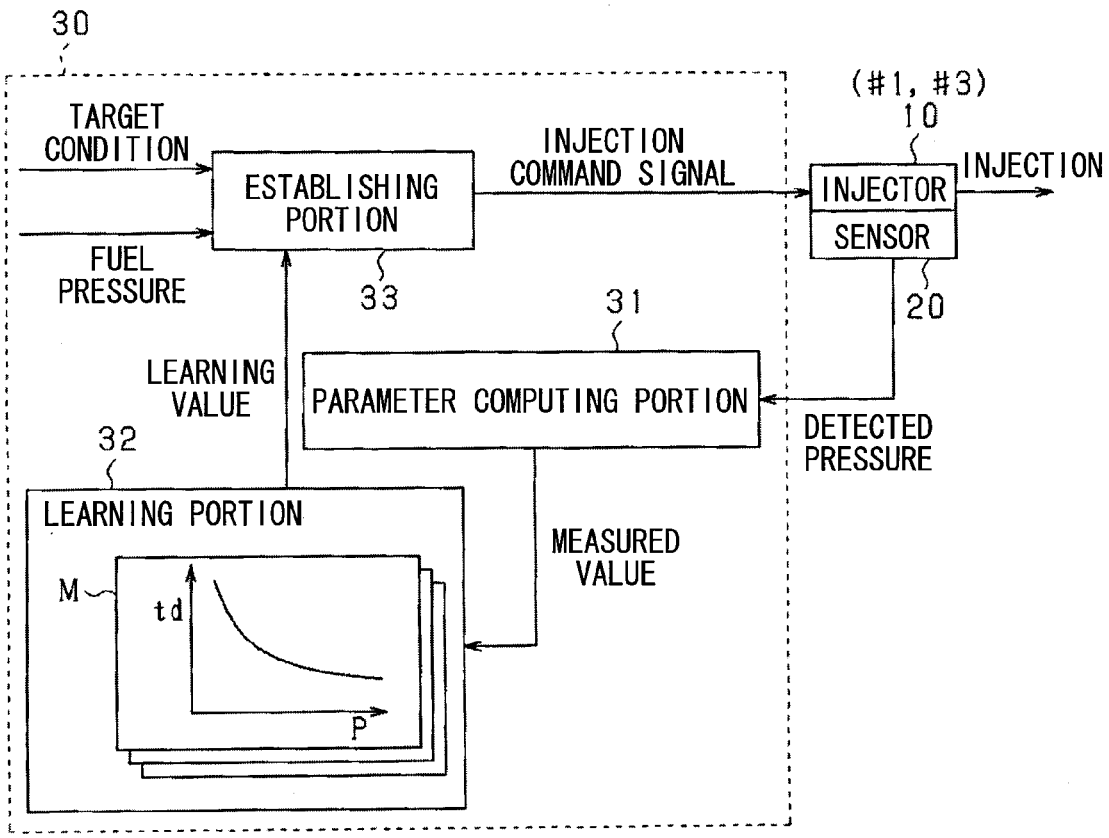
FIG. 3 is a block diagram showing a setting process of a fuel injection command signal which is transmitted to a fuel injector having a pressure sensor, according to the first embodiment.
Figure 4A:
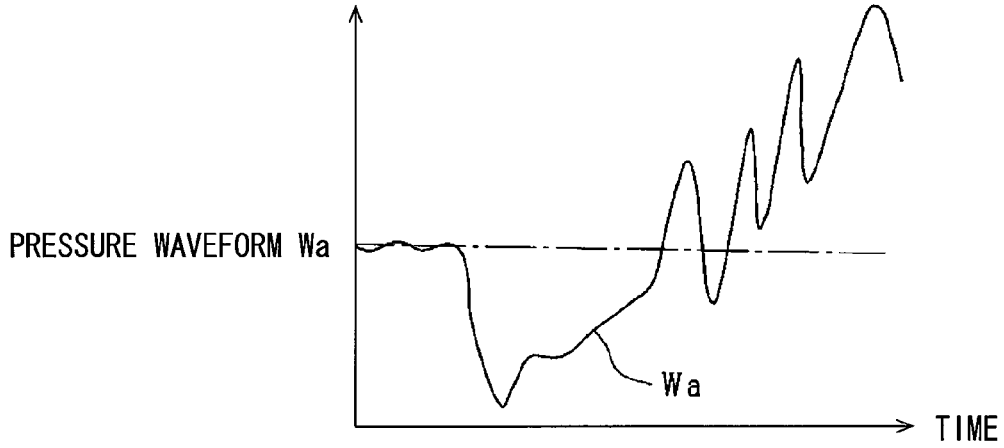
FIGS. 4A, 4B and 4C are charts which respectively show an injection-cylinder pressure waveform Wa, a non-injection-cylinder pressure waveform Wu, and an injection pressure waveform Wb.
Figure 4B:
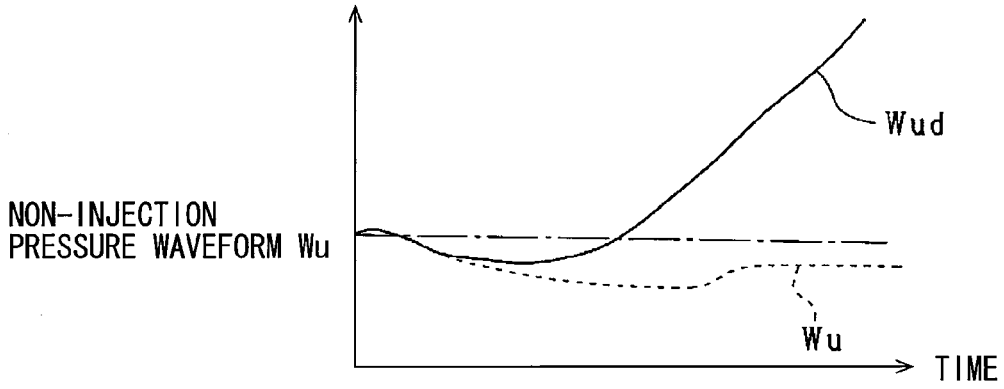
Figure 4C:
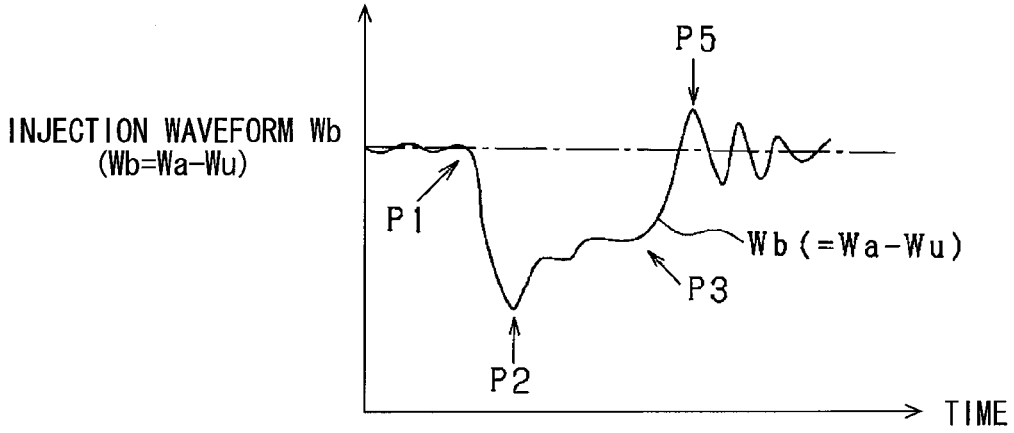

Referring to FIGS. 2 to 4, a processing of fuel injection control in the sensor-injector 10(#1, #3) will be described hereinafter.

For example, in a case that #1 fuel injector 10 mounted to #1 cylinder injects the fuel, a variation in fuel pressure due to a fuel injection is detected as a fuel pressure waveform (refer to FIG. 2C) based on detection values of the fuel pressure sensor 22 provided to #1 fuel injector 10 (sensor-injector). Based on the detected fuel pressure waveform, a fuel injection-rate waveform (refer to FIG. 2B) representing a variation in fuel injection quantity per a unit time is computed. Then, the injection-rate parameters Rα, Rβ and Rmax which identify the injection-rate waveform are learned, and the injection-rate parameters "te" and "td" which identify the correlation between the injection-command signals (pulse-on time point t1, pulse-off time point t2 and pulse-on period Tq) and the injection condition are learned.

Specifically, a descending pressure waveform from a point P1 to a point P2 is approximated to a descending straight line Lα by least square method. At the point P1, the fuel pressure starts to descend due to a fuel injection. At the point P2, the fuel pressure stops to descend. Then, a time point LBα at which the fuel pressure becomes a reference value Bα on the approximated descending straight line Lα is computed. Since the time point LBα and the fuel-injection-start time R1 have a high correlation with each other, the fuel-injection-start time R1 is computed based on the time point LBα. Specifically, a time point prior to the time point LBα by a specified time delay Cα is defined as the fuel-injection-start time R1.

Further, an ascending pressure waveform from a point P3 to a point P5 is approximated to an ascending straight line Lβ by least square method. At the point P3, the fuel pressure starts to ascend due to a termination of a fuel injection. At the point P5, the fuel pressure stops to ascend. Then, a time point LBβ at which the fuel pressure becomes a reference value Bβ on the approximated ascending straight line Lβ is computed. Since the time point LBβ and the fuel-injection-end time R4 have a correlation with each other, the fuel-injection-end time R4 is computed based on the time point LBβ. Specifically, a time point prior to the time point LBβ by a specified time delay Cβ is defined as the fuel-injection-end time R4.

In view of a fact that an inclination of the descending straight line Lα and an inclination of the injection-rate increase have a high correlation with each other, an inclination of a straight line Rα, which represents an increase in fuel injection-rate in FIG. 2B, is computed based on an inclination of the descending straight line Lα. Specifically, an inclination of the straight line Lα is multiplied by a specified coefficient to obtain the inclination of the straight line Rα. Similarly, in view of a fact that an inclination of the ascending straight line Lβ and an inclination of the injection-rate decrease have a high correlation with each other, an inclination of a straight line Rβ, which represents a decrease in fuel injection-rate, is computed based on an inclination of the ascending straight line Lβ.

Then, based on the straight lines Rα, Rβ, a valve-close start time R23 is computed. At this time R23, the valve body 12 starts to be lifted down along with a fuel-injection-end command signal. Specifically, an intersection of the straight lines Rα and Rβ is defined as the valve-close start time R23. Further, a fuel-injection-start time delay "td" of the fuel-injection-start time R1 relative to the pulse-on time point t1 is computed. Also, a time delay "te" of the valve-close start time R23 relative to the pulse-off time point t2 is computed.

An intersection of the descending straight line Lα and the ascending straight line Lβ is obtained and a pressure corresponding to this intersection is computed as an intersection pressure Pαβ. Further, a differential pressure ΔPγ between a reference pressure Pbase and the intersection pressure Pαβ is computed. In view of the fact that the differential pressure ΔPγ and the maximum injection-rate Rmax have a high correlation with each other, the maximum injection-rate Rmax is computed based on the differential pressure ΔPγ. Specifically, the differential pressure ΔPγ is multiplied by a correlation coefficient Cγ to compute the maximum injection-rate Rmax. However, in a case that the differential pressure ΔPγ is less than a specified value ΔPγth (small injection), the maximum fuel injection-rate Rmax is defined as follows:

$$Rmax=\Delta P\gamma\times C\gamma$$

In a case that the differential pressure ΔPγ is not less than the specified value ΔPγth (large injection), a predetermined value Rγ is defined as the maximum injection-rate Rmax.

The small injection corresponds to a case in which the valve 12 starts to be lifted down before the injection-rate reaches the predetermined value Rγ. The fuel injection quantity is restricted by the seat surface 12*a*. Meanwhile, the large-injection corresponds to a case in which the valve 12 starts to be lifted down after the injection-rate reaches the predetermined value Rγ. The fuel injection quantity depends on the flow area of the injection port 11*b*. Incidentally, when the injection command period "Tq" is long enough and the injection port 11*b* has been opened even after the maximum injection-rate is achieved, the shape of the injection-rate waveform becomes trapezoid, as shown in FIG. 2B. Meanwhile, in a case of the small-injection, the shape of the injection-rate waveform becomes triangle.

The above predetermined value Rγ, which corresponds to the maximum injection-rate Rmax in case of the large-injection, varies along with an aging deterioration of the fuel injector 10. For example, if particulate matters are accumulated in the injection port 11*b* and the fuel injection quantity decreases along with age, the pressure drop amount ΔP shown in FIG. 2C becomes smaller. Also, if the seat surface 12*a* is worn away and the fuel injection quantity is increased, the pressure drop amount ΔP becomes larger. It should be noted that the pressure drop amount ΔP corresponds to a detected pressure drop amount which is caused due to a fuel injection. For example, it corresponds to a pressure drop amount from the reference pressure Pbase to the point P2, or from the point P1 to the point P2.

In the present embodiment, in view of the fact that the maximum injection-rate Rmax (predetermined value Rγ) in a large-injection has high correlation with the pressure drop amount ΔP, the predetermined value Rγ is established based on the pressure drop amount ΔP. That is, the learning value of the maximum injection-rate Rmax in the large-injection corresponds to a learning value of the predetermined value Rγ based on the pressure drop amount ΔP.

As above, the injection-rate parameters td, te, Rα, Rβ, Rmax can be derived from the fuel pressure waveform. Then, based on the learning values of these parameters td, te, Rα, Rβ, Rmax, the injection-rate waveform (refer to FIG. 2B) corresponding to the fuel-injection-command signals (FIG. 2A) can be computed. An area of the computed injection-rate waveform (shaded area in FIG. 2B) corresponds to a fuel injection quantity. Thus, the fuel injection quantity can be computed based on the injection-rate parameters.

FIG. 3 is a block diagram showing a learning process of an injection-rate parameter and a setting process of an injection command signal transmitted to the sensor-injectors 10(#1, #3). Specifically, FIG. 3 shows a configuration and functions of the ECU 30. An injection-rate-parameter computing portion 31 computes the injection-rate parameters td, te, Rα, Rβ, Rmax based on the fuel pressure waveform detected by the fuel pressure sensor 22.

A learning portion 32 learns the computed injection-rate parameters and stores the updated parameters in a memory 30*a* of the ECU 30. Since the injection-rate parameters vary according to the supplied fuel pressure (fuel pressure in the common-rail 42) and the fuel temperature, it is preferable that the injection-rate parameters are learned in association with the supplied fuel pressure or a reference pressure Pbase (refer to FIG. 2C) and the fuel temperature detected by the fuel temperature sensor 23. The fuel injection-rate parameters relative to the fuel pressure are stored in an injection-rate parameter map M shown in FIG. 3.

An establishing portion 33 obtains the injection-rate parameter (learning value) corresponding to the current fuel pressure from the injection-rate parameter map M. Then, based on the computed injection-rate parameters, the injection-command signals "t1", "t2", "Tq" corresponding to the target injection condition are established. When the fuel injector 10 is operated according to the above injection-command signals, the fuel pressure sensor 22 detects the fuel pressure waveform. Based on this fuel pressure waveform, the injection-rate-parameter computing portion 31 computes the injection-rate parameters td, te, Rα, Rβ, Rmax.

That is, the actual fuel injection condition (injection-rate parameters td, te, Rα, Rβ, Rmax) relative to the fuel-injection-command signals is detected and learned. Based on this learning value, the fuel-injection-command signals corresponding to the target injection condition are established. Therefore, the fuel-injection-command signals are feedback controlled based on the actual injection condition, whereby the actual injection condition is accurately controlled in such a manner as to agree with the target injection condition even if the deterioration with age is advanced. Especially, the injection command period "Tq" is feedback controlled based on the injection-rate parameter so that the actual fuel injection quantity agrees with the target fuel injection quantity.

In the following description, a cylinder in which a fuel injection is currently performed is referred to as an injection cylinder and a cylinder in which no fuel injection is currently performed is referred to as a non-injection cylinder. Further, a fuel pressure sensor 22 provided in the injection cylinder 10 is referred to as an injection-cylinder pressure sensor and a fuel pressure sensor 22 provided in the non-injection cylinder 10 is referred to as a non-injection-cylinder pressure sensor.

The fuel pressure waveform Wa (refer to FIG. 4A) detected by the injection-cylinder pressure sensor 22 includes not only the waveform due to a fuel injection but also the waveform due to other matters described below. In a case that the fuel pump 41 intermittently supplies the fuel to the common-rail 42, the entire fuel pressure waveform Wa ascends when the fuel pump supplies the fuel while the fuel injector 10 injects the fuel. That is, the fuel pressure waveform Wa includes a fuel pressure waveform Wb (refer to FIG. 4C) representing a fuel pressure variation due to a fuel injection and a pressure waveform Wud (refer to FIG. 4B) representing a fuel pressure increase by the fuel pump 41.

Even in a case that the fuel pump 41 supplies no fuel while the fuel injector 10 injects the fuel, the fuel pressure in the fuel injection system decreases immediately after the fuel injector 10 injects the fuel. Thus, the entire fuel pressure waveform Wa descends. That is, the fuel pressure waveform Wa includes a waveform Wb representing a fuel pressure variation due to a fuel injection and a waveform Wu (refer to FIG. 4B) representing a fuel pressure decrease in the fuel injection system.

Since the pressure waveform Wud (Wu) represents the fuel pressure in the common-rail 42, the non-injection pressure waveform Wud (Wu) is subtracted from the injection pressure waveform Wa detected by the injection-cylinder pressure sensor 22 to obtain the injection waveform Wb. The fuel pressure waveform shown in FIG. 2C is the injection waveform Wb.

Moreover, in a case that a multiple-injection is performed, a pressure pulsation Wc due to a prior injection, which is shown in FIG. 2C, overlaps with the fuel pressure waveform Wa. Especially, in a case that an interval between injections is short, the fuel pressure waveform Wa is significantly influenced by the pressure pulsation Wc. Thus, it is preferable that the pressure pulsation Wc and the non-injection pressure waveform Wu (Wud) are subtracted from the fuel pressure waveform Wa to compute the injection waveform Wb.

The injection control regarding the sensor-injectors 10(#1, #3) is described above based on FIGS. 2 to 4. Hereinafter, the injection control regarding no-sensor-injector 10(#2, #4) will be described. The fuel injection quantity injected from the no-sensor-injector 10(#2, #4) is estimated according to following method and an injection-command signal Tq corresponding to the target injection condition is established based on the estimated injection quantity.

Figure 5:
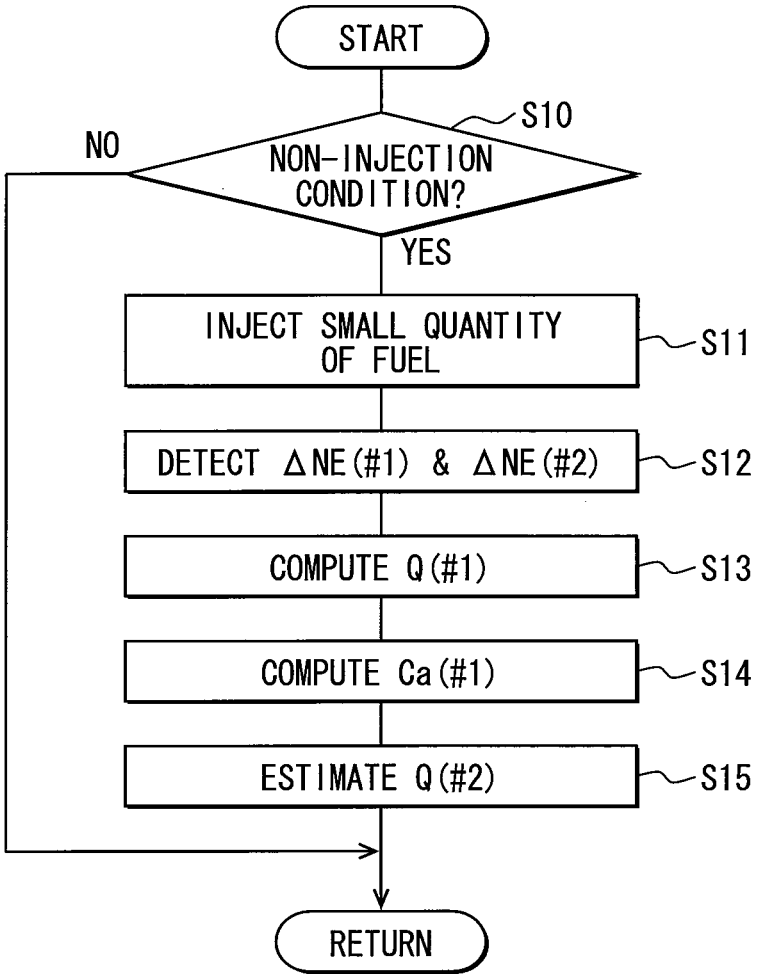
FIG. 5 is a flowchart showing a processing for estimating a fuel injection quantity injected by a no-sensor-injector.

FIG. 5 is a flowchart showing a processing for estimating a fuel injection quantity injected from the no-sensor-injector 10(#2, #4). The microcomputer of the ECU 30 repeatedly executes this processing at specified intervals.

In step S10, the computer determines whether the engine is in a non-injection condition where no fuel injector injects fuel and whether the engine speed is decreasing. When the answer is YES in step S10, the procedure proceeds to step S11 in which the sensor-injector 10(#1) and the no-sensor injector 10(#2) sequentially inject small quantity of fuel, which is previously established less than a specified quantity.

Specifically, the injection command period Tq(#1) to the sensor-injector 10(#1) is set equal to the injection command period Tq(#2) to the no-sensor-injector 10(#2). Moreover, in a case that the pulse-on time point t1*a* regarding the period Tq(#1) is advanced relative to a top dead center by a specified crank angle (refer to FIG. 6), the pulse-on time point t1*b* regarding the period Tq(#2) is also advanced by the same crank angle. That is, the injection conditions in each cylinder are made equal to each other.

Moreover, a rotation angle of the crankshaft from the pulse-on time point t1*a* of the sensor-injector 10(#1) to the pulse-on time point t2*b* of the no-sensor-injector 10(#2) is established less than a specified angle. In other words, a time interval between the time point t1*a* and the time point t1*b* is established less than a specified time period. In the present embodiment shown in FIG. 6, immediately after the sensor-injector 10(#1) injects the small quantity of fuel, the no-sensor-injector 10(#2) injects the small quantity of fuel.

Figure 6:
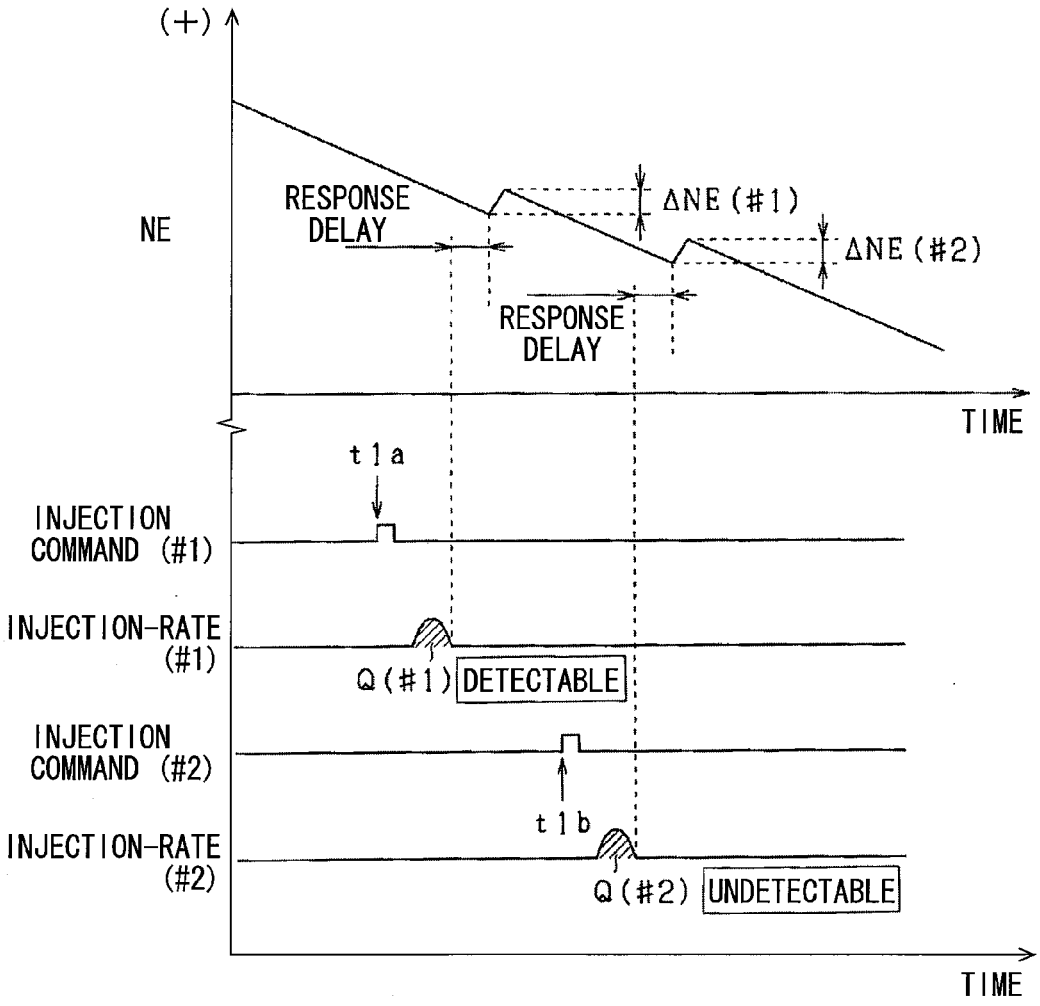
FIG. 6 is a time chart showing a small injection executed according to the processing shown in FIG. 5.

FIG. 6 is a time chart showing a small injection which is executed in step S11. When the injection commands are transmitted to the sensor-injector 10(#1) and the no-sensor-injector 10(#2), the small quantity of fuel denoted by Q(#1) and Q(#2) is injected from the injectors 10(#1) and 10(#2) respectively. As a result, the engine speed NE is increased by ΔNE(#1) and ΔNE(#2). These increases ΔNE(#1) and ΔNE (#2) represent increases in engine output due to fuel combustion of quantity Q(#1) and Q(#2).

Referring back to FIG. 5, in step S12 (output detecting portion), the computer detects the increases ΔNE(#1) and ΔNE(#2) in engine speed NE with respect to small injection quantities Q(#1) and Q(#2). It should be noted that the increase ΔNE(#1) corresponds to a first output and the increase ΔNE(#2) corresponds to a second output.

In step S13 (first injection quantity computing portion), the computer computes an actual injection quantity Q(#1), which the sensor-injector 10(#1) injects, based on the detection value of the fuel pressure sensor 22. In step S14 (first correlative value computing portion), the computer computes a first correlative value Ca(#1) between the increase ΔNE(#1) detected in step S12 and the actual injection quantity Q(#1) obtained in step S13. Specifically, the first correlative value Ca(#1) is computed according to the following formula (1):

$$Ca(\#1)=Q(\#1)/\Delta NE(\#1) \quad (1)$$

In step S15 (second injection quantity estimating portion), the computer estimates the actual injection quantity Q(#2), which the no-sensor-injector 10(#2) injects, based on the first correlative value Ca(#1) and the increase ΔNE(#2). Specifically, the actual injection quantity Q(#2) is computed according to the following formula (2):

$$Q(\#2)=Ca(\#1)\times\Delta NE(\#2) \quad (2)$$

That is, it is assumed that the first correlative value Ca(#1) is almost equal to a second correlative value Ca(#2) regarding the no-sensor-injector 10(#2). The undetectable injection quantity Q(#2) is estimated based on the detectable injection quantity Q(#1), the detectable increase ΔNE(#1) and the detectable increase ΔNE(#2). It should be noted that the injection quantity Q(#1) corresponds to a first injection quantity and the injection quantity Q(#2) corresponds to a second injection quantity.

As described above, regarding the injection control of the sensor-injector 10(#1), the injection command signals t1, t2, Tq are established in view of the map M which stores learned injection-rate parameters. Meanwhile, regarding the no-sensor-injector 10(#2), the injection control is executed based on a Tq-Q map which defines the injection command period Tq with respect to the target injection quantity Q. Preferably, the Tq-Q map defines the injection command period Tq relative to the target injection quantity Q in association with the reference pressure Pbase, the engine speed, the fuel temperature and the like. The Tq-Q map is stored in the memory 30*a*.

Then, the value of Tq in the Tq-Q map is corrected based on the estimated injection quantity Q(#2) and the command period Tq which is transmitted to the no-sensor-injector 10(#2) in step S11. For example, a ratio of Tq(#2) to Q(#2) is computed and the value of Tq in the Tq-Q map is corrected so that the above ratio is obtained.

According to the present embodiment, as described above, the small injection quantity Q(#2) which the no-sensor-injector 10(#2) injects can be estimated without using a conversion map for converting the increase ΔNE(#2) into the small injection quantity Q(#2). Further, since the Tq-Q map is corrected based on the estimated small injection quantity Q(#2), the injection condition of the no-sensor-injector 10(#2) can be controlled with high accuracy.

Moreover, according to the present embodiment, since the increases ΔNE(#1, #2) corresponding to the first output and the second output are detected by performing the small injection while the engine is in a non-injection condition (S10: YES), the increases ΔNE(#1, #2) can be accurately detected, whereby the estimation accuracy of the small injection quantity Q(#2) can be improved.

As a time period t1*a*-t1*b* from the pulse-on time point t1*a* until the pulse-on time point t1*b* becomes longer, a difference between the injection condition of the sensor-injector 10(#1) and the injection condition of the no-sensor-injector 10(#2) may become larger. If the injection condition becomes different as above, a deviation between the first correlative value Ca(#1) and the second correlative value Ca(#2) becomes larger. It is likely that the estimation accuracy of the small injection quantity Q(#2) may be deteriorated. In view of the above, according to the present embodiment, the small injection is conducted in such a manner that the time period t1*a*-t1*b* becomes less than a specified time period, whereby the injection conditions of the sensor-injectors 10(#1) and the no-sensor-injector 10(#2) are substantially the same.

Second Embodiment

Figure 7:
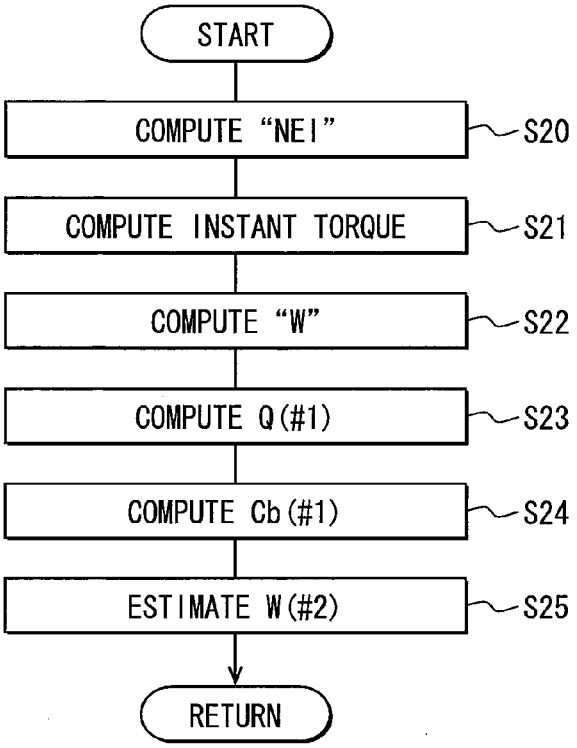
FIG. 7 is a flowchart showing a processing for estimating a fuel injection quantity injected by a no-sensor-injector, according to a second embodiment.
Figure 8:
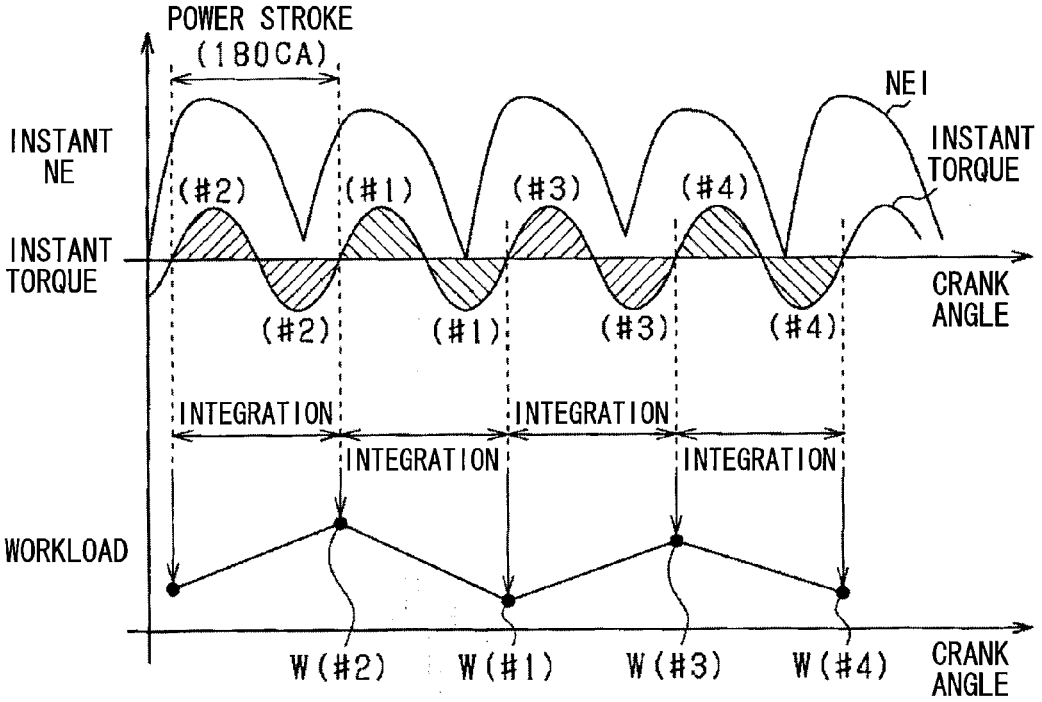
FIG. 8 is a time chart showing an estimation shown in FIG. 7.

In the above first embodiment, when the engine is in a non-injection condition (S10: YES), the small injection is performed so that the increases ΔNE (first output and second output) are detected. According to a second embodiment, when the engine is ordinally running, an instant engine speed NEI is successively detected. Then, based on a variation in the instant engine speed NEI, the first output and the second output are detected. Referring to FIGS. 7 and 8, an estimating method for estimating a fuel injection quantity injected from the no-sensor-injector 10(#2) will be described hereinafter.

A processing shown in FIG. 7 is executed at a specified interval by a microcomputer of the ECU 30 while the engine is running. In step S20, the computer computes an instant engine speed NEI. FIG. 8 shows the instant engine speed NEI.

In step S21 (output detecting portion), the computer computes an instant value of engine output (instant torque) based on the instant engine speed NEI computed in step S20. Specifically, a variation rate of the instant engine speed NEI is multiplied by a conversion coefficient to compute the instant torque. This instant torque is illustrated in FIG. 8.

In step S22 (output detecting portion), the computer computes a workload W in each cylinder based on the instant torque computed in step S21. Specifically, in a combustion stroke (180° CA) of each cylinder, an integrated value of the instant torque (shaded area in FIG. 8) is defined as the workload W. In FIG. 8, the workload in each cylinder is denoted by W(#1) to W(#4).

It should be noted that the workload W(#1) corresponds to a first output and the workload W(#2) corresponds to a second output. Incidentally, the injection command signal Tq to each cylinder may be corrected so that a variation in workload W(#1)-W(#4) of each cylinder is decreased.

In step S23 (first injection quantity computing portion), the computer computes an actual injection quantity Q(#1), which the sensor-injector 10(#1) injects, based on the detection value of the fuel pressure sensor 22. The injection quantity Q(#1) contributes to obtain the workload W(#1) in the #1 cylinder.

In step S24, the computer computes a correlative value Cb(#1) between the workload W(#1) computed in step S22 and the actual injection quantity Q(#1) obtained in step S23. Specifically, a ratio between the actual injection quantity Q(#1) and the workload W(#1) is computed as the correlative value Cb(#1). The correlative value Cb(#1) corresponds to a first correlative value.

In step S25 (second injection quantity estimating portion), the computer estimates the actual injection quantity Q(#2), which the no-sensor-injector 10(#2) injects, based on the correlative value Cb(#1) computed in step S24 and the workload W(#2) in #2 cylinder detected in step S22. Specifically, the actual injection quantity Q(#2) is computed by multiplying the workload W(#2) by the correlative value Cb(#1).

That is, it is assumed that the correlative value Cb(#1) is almost equal to the correlative value Cb(#2). The injection quantity Q(#2) is estimated based on the injection quantity Q(#1), the workload W(#1), and the workload W(#2).

Regarding the injection control of the sensor-injector 10(#1), the injection command signals t1, t2, Tq are established in view of the injection-rate parameter map M. The injection control of the no-sensor-injector 10(#2) is conducted by using of the Tq-Q map. Then, the value of Tq in the Tq-Q map is corrected based on the estimated injection quantity Q(#2) and the command period Tq which is transmitted to the no-sensor-injector 10(#2). For example, a ratio of Tq(#2) to Q(#2) is computed and the value of Tq in the Tq-Q map is corrected so that the above ratio is obtained.

According to the present embodiment, as described above, the small injection quantity Q(#2) which the no-sensor-injector 10(#2) injects can be estimated without using a conversion map for converting the workload W(#2) into the small injection quantity Q(#2). Further, since the Tq-Q map is corrected based on the estimated small injection quantity Q(#2), the injection condition of the no-sensor-injector 10(#2) can be controlled with high accuracy.

Moreover, according to the present embodiment, regardless of the engine driving condition, the injection quantity Q(#2) of the no-sensor-injector 10(#2) can be estimated. Thus, an opportunity (learning opportunity) for correcting Tq-Q map is increased, so that the accuracy of the Tq-Q map can be improved.

Third Embodiment

Figure 9:
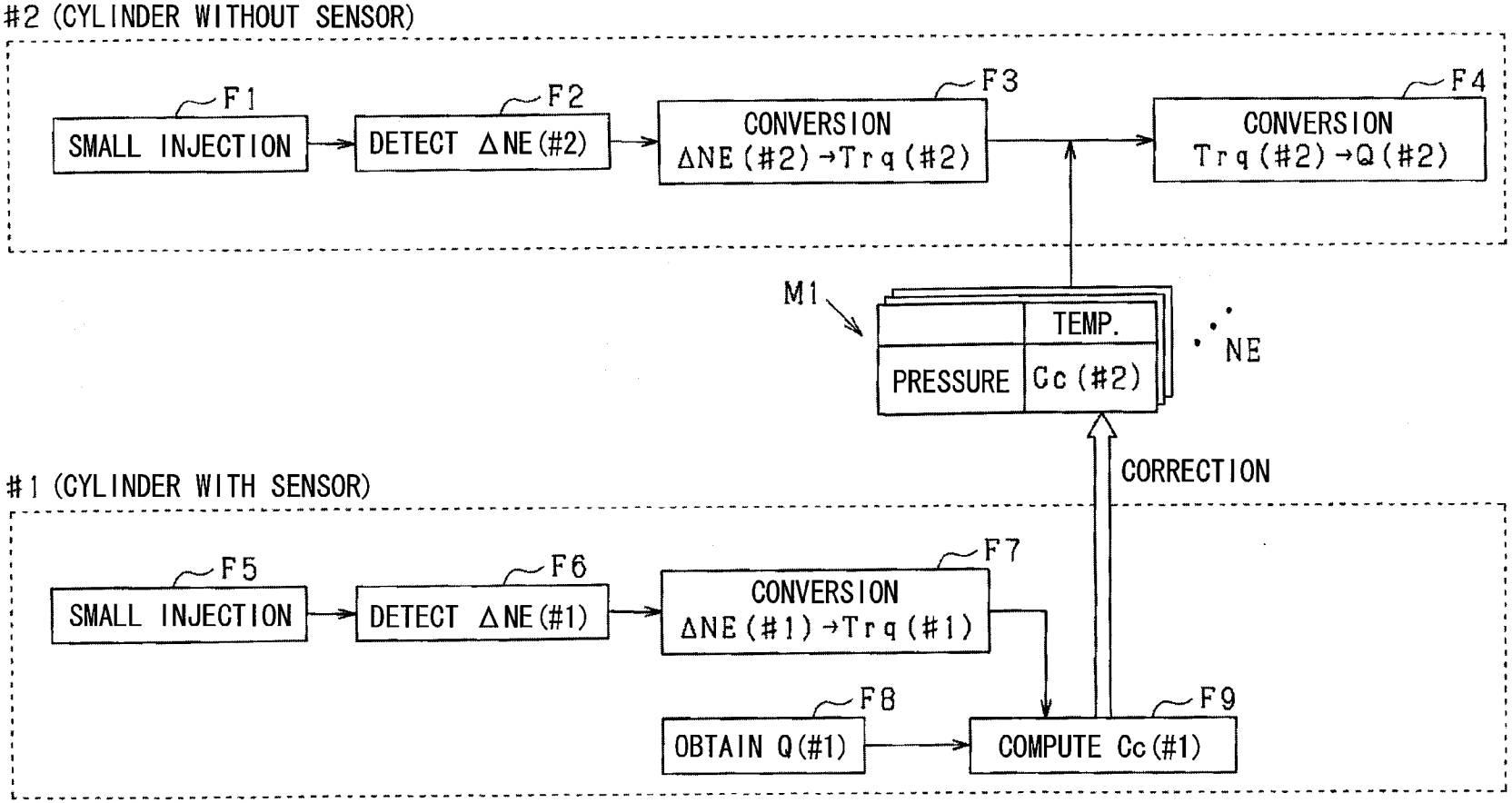
FIG. 9 is a block chart showing a processing for estimating a fuel injection quantity injected by a no-sensor-injector, according to a third embodiment.

According to a third embodiment, the computer computes the small injection quantity Q(#2) of the no-sensor-injector 10(#2) by using of a conversion map for converting the increase ΔNE(#2) into the small injection quantity Q(#2). Referring to FIG. 9, a computing method of the small injection quantity Q(#2) will be described hereinafter.

When the vehicle is decelerated without injecting fuel, a first portion F1 performs a small injection in the same way as steps S10 to S12 in FIG. 5. A second portion F2 detects an increase ΔNE(#2) in engine speed. A third portion F3 converts the detected increase ΔNE(#2) into an output torque Trq(#2) of the engine. A variation rate of the instant engine speed NEI is multiplied by a conversion coefficient to compute an instant engine torque. The computed instant engine torque is integrated in a range of a compression stroke (180° CA). This integrated value is computed as the engine output torque Trq(#2).

The memory 30*a* stores a map M1 shown in FIG. 9. A correlation value Cc(#2) between the output torque Trq(#2) and the injection quantity Q(#2) is previously obtained by experiments. This obtained correlation value Cc(#2) is stored as the map M1 in association with experiment conditions. The experiment conditions includes the reference fuel pressure Pbase at the small injection, the engine speed NE, the fuel temperature and the like.

Then, a fourth portion F4 converts the output torque Trq(#2) into the injection quantity Q(#2) by using of a correlation value Cc(#2) corresponding to a condition of when the first portion F1 performs the small injection. Specifically, the torque Trq(#2) is multiplied by the correlation value Cc(#2) to obtain the injection quantity Q(#2).

Meanwhile, regarding the sensor-injector 10(#1), a fifth portion F5 performs a small injection in the same way as steps S10 to S12 in FIG. 5, a sixth portion F6 detects an increase ΔNE(#1) in engine speed, and a seventh portion F7 converts the detected increase ΔNE(#1) into an output torque Trq(#1) of the engine. Then, an eighth portion F8 obtains the actual injection quantity Q(#1) of when the first portion F1 performs the small injection, based on the detection value of the fuel pressure sensor 22.

Then, a ninth portion F9 computes a correlation value Cc(#1) between the output torque Trq(#1) computed by the seventh portion F7 and the actual injection quantity Q(#1) obtained by the eighth portion F8. Specifically, a ratio between the actual injection quantity Q(#1) and the output torque Trq(#1) is computed as the correlative value Cc(#1). It should be noted that the correlative value Cc(#1) corresponds to a first correlative value, and the correlative value Cc(#2) corresponds to a second correlative value.

Furthermore, the ninth portion F9 (correcting portion) corrects the correlative value Cc(#2) stored in the map M1 by means of the computed correlative value Cc(#1). Specifically, the correlative value Cc(#2) corresponding to a condition of when the fifth portion F5 performs the small injection is replaced by the correlative value Cc(#1). Alternatively, the correlative value Cc(#2) is corrected in such a manner as to be close to the correlative value Cc(#1).

That is, when the reference pressure Pbase, the engine speed, the fuel temperature and the like are substantially the same, it is assumed that the correlative value Cc(#1) regarding the sensor-injector 10(#1) is equal to the correlative value Cc(#2) regarding the no-sensor-injector 10(#2). The undetectable correlative value Cc(#2) is corrected based on the detectable correlative value Cc(#1).

According to the present embodiment, even though the map M1 for converting the output torque Trq(#2) into the injection quantity Q(#2) is necessary for the no-sensor-injector 10(#2), the map M1 is corrected by using of the correlative value Cc(#1) regarding the sensor-injector 10(#1), whereby the accuracy of the correlative value Cc(#2) regarding no-sensor-injector 10(#2) can be enhanced.

When storing the correlative value Cc(#2) in association with the reference pressure Pbase, the engine speed NE, the fuel temperature and the like, the number of data of the correlative value Cc(#2) can be reduced. Therefore, the workload for forming the map M1 by experiments can be reduced.

Other Embodiment

The present disclosure is not limited to the embodiments described above, but may be performed, for example, in the following manner. Further, the characteristic configuration of each embodiment can be combined.

In the first embodiment, an increase ΔNE in engine speed NE due to a small injection is assumed as an increase in engine output. Instead of detecting the increase ΔNE, a pressure in a combustion chamber is detected by a combustion pressure sensor and an increase in combustion pressure may be assumed as the increase in engine output.

In the second embodiment, the instant torque (workload W) is computed based on a variation in engine speed NE. However, the instant torque (workload W) may be computed based on the variation in combustion pressure.

In the first embodiment, the correlative value Ca(#1) between the increase ΔNE(#1) and the injection quantity Q(#1) is used for estimating the injection quantity Q(#2). However, an increase in output torque Trq(#1) is computed based on the increase ΔNE(#1), and a correlative value between the increase in torque Trq(#1) and the increase ΔNE(#1) may be used for estimating the injection quantity Q(#2).

Although two cylinders are respectively provided with the fuel pressure sensor 22 in the above embodiments, only one cylinder may be provided with the fuel pressure sensor 22. Also, the fuel pressure sensor 22 can be arranged at any place in a fuel supply passage between an outlet 42*a* of the common-rail 42 and the injection port 11*b*. For example, the fuel pressure sensor 22 can be arranged in a high-pressure pipe 42*b* connecting the common-rail 42 and the fuel injector 10.

What is claimed is:

1. A fuel injection controller applied to a fuel injection system including a first fuel injector provided in a first cylinder of an engine; a second fuel injector provided in a second cylinder of the engine; and a fuel pressure sensor, provided to only the first fuel injector and not the second fuel injector, for detecting a variation in fuel pressure only in the first fuel injector when the first fuel injector injects a fuel, the fuel injection controller comprising a computer processor, the fuel injection controller being configured to at least perform:

an output detection which detects a first output generated by a combustion of a fuel which the first fuel injector injects and a second output generated by a combustion of a fuel which the second fuel injector injects;

a first injection quantity computation which computes a first injection quantity injected by the first fuel injector to generate the first output, based on a detection value of the fuel pressure sensor;

a first correlative value computation which computes a first correlative value indicative of a correlation between the first output and the first injection quantity;

a second injection quantity estimation which estimates a second injection quantity injected by the second fuel injector, wherein the second injection quantity is based on the second output and the first correlative value indicative of the correlation between the first output and the first injection quantity; and a control of an operation of the fuel injection system based on the estimated second injection quantity, wherein the first output is an increase in engine speed or an increase combustion pressure; and the second output is an increase in engine speed or an increase in combustion pressure.

2. A fuel injection controller according to claim 1, wherein the first fuel injector and the second fuel injector successively compulsorily inject the fuel of which quantity is less than a specified quantity when no fuel is injected in order to decrease an engine speed; and the output detection detects the first output and the second output which are respectively generated due to compulsory injections by the first injector and the second injector.

3. A fuel injection controller according to claim 1, wherein when the first fuel injector and the second fuel injector successively inject the fuel, the output detection detects the first output and the second output generated due to injections by the first injector and the second injector.

4. A fuel injection controller applied to a fuel injection system including a first fuel injector provided in a first cylinder of an engine; a second fuel injector provided in a second cylinder of the engine; and a fuel pressure sensor, provided to only the first fuel injector and not the second fuel injector, for detecting a variation in fuel pressure only in the first fuel injector when the first fuel injector injects a fuel, the fuel injection controller comprising a computer processor, the fuel injection controller being configured to at least perform:

an output detection which detects a first output generated by a combustion of a fuel which the first fuel injector injects and a second output generated by a combustion of a fuel which the second fuel injector injects;

a first injection quantity computation which computes a first injection quantity injected by the first fuel injector to generate the first output, based on a detection value of the fuel pressure sensor;

a storage, in a memory, of a second correlative value indicative of a correlation between the second output and the second injection quantity, the second correlative value being previously obtained by an experiment;

a correction which corrects the second correlative value stored in the memory based on a first correlative value indicative of the correlation between the first output and the first injection quantity;

a second injection quantity estimation which estimates a second injection quantity injected by the second fuel injector, wherein the second injection quantity is based on the second output and the first correlative value indicative of the correlation between the first output and the first injection quantity; and a control of an operation of the fuel injection system based on the estimated second injection quantity, wherein:

the second injection quantity estimation estimates the second injection quantity based on the second correlative value corrected by the correction and the detected second output;

the first output is an increase in engine speed or an increase in combustion pressure; and the second output is an increase in engine speed or an increase in combustion pressure.

* * * * *